US006109386A

United States Patent [19]

Maus et al.

[11] Patent Number: 6,109,386

[45] Date of Patent: Aug. 29, 2000

[54] HONEYCOMB BODY WITH A FLATTENED CROSS-SECTIONAL REGION AND A METHOD FOR PRODUCING THE HONEYCOMB BODY

[75] Inventors: Wolfgang Maus; Rolf Brück, both of Bergisch Gladbach, Germany

[73] Assignee: Emitec Gesellschaft fuer Emissionstechnologie mbH, Lohmar, Germany

[21] Appl. No.: 09/370,233

[22] Filed: Aug. 9, 1999

Related U.S. Application Data

[63] Continuation of application No. PCT/EP98/00571, Feb. 3, 1998.

[51] Int. Cl.[7] ..... F01N 1/28; F01N 3/28

[52] U.S. Cl. ..... 181/158; 60/299; 422/180; 502/527.19

[58] Field of Search ..... 181/158, 182; 60/299; 422/171, 180; 502/439, 527.19, 527.22

[56] References Cited

U.S. PATENT DOCUMENTS

| | | | |
|---|---|---|---|
| 3,597,165 | 8/1971 | Keith et al. . | |
| 5,055,274 | 10/1991 | Abbott | 422/180 |
| 5,113,653 | 5/1992 | Usui et al. | 60/299 |
| 5,338,903 | 8/1994 | Winberg | 181/258 |

FOREIGN PATENT DOCUMENTS

| | | |
|---|---|---|
| 0 121 175 B1 | 1/1987 | European Pat. Off. . |
| 0 152 560 B1 | 7/1987 | European Pat. Off. . |
| 0 245 737 A1 | 11/1987 | European Pat. Off. . |
| 0 245 738 A1 | 11/1987 | European Pat. Off. . |
| 0 470 113 B1 | 2/1993 | European Pat. Off. . |
| 0 484 364 B1 | 9/1993 | European Pat. Off. . |
| 0 635 627 A2 | 1/1995 | European Pat. Off. . |
| 0 049 489 B1 | 6/1985 | Germany . |
| 0 121 174 B1 | 9/1986 | Germany . |
| 36 22 115 C1 | 9/1987 | Germany . |
| 38 29 668 A1 | 6/1989 | Germany . |
| 42 43 079 A1 | 9/1994 | Germany . |

OTHER PUBLICATIONS

International Patent Application WO 93/20339 (Brück), dated Oct. 14, 1993.

German Utility Model G 85 21 814.6, dated Mar. 23, 1989, metallic wound catalytic converter support body with a geometrically complex cross–section.

German Utility Model DE 296 11 143.0, dated Oct. 24, 1996, conical honeycomb body with longitudinal structures.

*Primary Examiner*—Khanh Dang

*Attorney, Agent, or Firm*—Herbert L. Lerner; Laurence A. Greenberg; Werner H. Stemer

[57] ABSTRACT

A honeycomb body that including wound sheet-metal layers including structured sheet-metal layers with structuring. The wound sheet-metal layers form an upper side, a lower side disposed remote from the upper side, a first edge region and a second edge region laterally extending from the upper side to the lower side. The second edge region is disposed remote from the first edge region. The wound sheet-metal layers are fixed in a common fixing zone at the first edge region. The structuring of the structured sheet-metal layers is at least partially flattened at the fixing zone so that adjacent wound sheet-metal layers lie close against each other at the common fixing zone. The wound sheet-metal layers preferably form a region with a flattened cross-sectional area. A muffler of an exhaust gas system of an internal combustion engine that includes the honeycomb body is also provided. In addition, a two-region housing that includes the honeycomb body is provided. Finally, a process for producing the honeycomb body is provided.

42 Claims, 6 Drawing Sheets

HONEYCOMB BODY WITH A FLATTENED CROSS-SECTIONAL REGION AND A METHOD FOR PRODUCING THE HONEYCOMB BODY

CROSS-REFERENCE TO RELATED APPLICATION

This is a continuation of copending International application PCT/EP98/00571, filed Feb. 3, 1998, which designated the United States.

BACKGROUND OF INVENTION

1. Field of Invention

The present invention relates, in general, to a honeycomb body, and a method of producing a honeycomb body. In particular, the honeycomb body has a top side, an underside, a first end, a second end, and two lateral edge regions. The honeycomb body preferably has a flattened cross-sectional region and wound sheet-metal layers. They are preferably already coated with catalyticly active material. At least a portion of the sheet metal layers is structured. The invention further relates to a muffler with the honeycomb body for an exhaust gas system of an internal combustion engine and a housing having a top shell portion and a bottom shell portion which form a cavity for reciept of the honeycomb body.

Honeycomb bodies which have a plurality of passages through which a fluid can flow and which are surrounded by a metallic tubular casing are known for example from the published documents EP 0 049 489, EP 0 121 174, EP 0 121 175, EP 0 245 737 and EP 0 245 738. They show different basic forms of catalytic converter carrier bodies that are preferably used in exhaust systems of motor vehicle internal combustion engines.

Honeycomb bodies that have small dimensions for exhaust gas cleaning are used with small engines. Small engines are those with a cubic capacity of less than 250 cc, in particular less than 50 cc, and for example, are used in motor-driven saws, lawnmowers, or similar devices. Because of spatial restrictions, the honeycomb bodies often have to be configured in a partitioning wall in a cup-like enlargement of the exhaust gas system, with the cup-like enlargement simultaneously performing a sound-damping function.

Such configurations are known for example from DE 38 29 668 and U.S. Pat. No. 3,597,165. EP 0 470 113 also describes a honeycomb body that is fitted in a partitioning wall extending substantially perpendicularly to the through-flow direction. Features disclosed therein for small engines can also be used in the present invention.

SUMMARY OF THE INVENTION

It is accordingly an object of the invention to provide a honeycomb body that has a structure providing the sheet layers with a high degree of stability relative to each other, to provide a silencer or muffler and a housing that cooperates in a space-saving and stabilizing fashion with the honeycomb body, and to provide a process for producing the honeycomb body, which overcome the above-mentioned disadvantageous of the heretofore known devices and methods of this type.

With the foregoing and other objects in view there is provided, in accordance with the invention, a honeycomb body made from wound sheet-metal layers including structured sheet-metal layers with structuring. The wound sheet-metal layers form an upper side, a lower side disposed remote from the upper side, a first edge region and a second edge region laterally extending from the upper side to the lower side. The second edge region is disposed remote from the first edge region. The wound sheet-metal layers are fixed in a common fixing zone at the first edge region. The structuring of the structured sheet-metal layers is at least partially flattened at the fixing zone so that adjacent wound sheet-metal layers lie close against each other at the common fixing zone. The wound sheet-metal layers preferably form a region with a flattened cross-sectional area.

By providing the fixing zone in the lateral edge region and by forming the region with a flattened or oblate cross-sectional area from the wound sheet-metal layers, it possible to prevent the sheet layers from suffering from so-called "telescoping". When a honeycomb body is subjected to vibrations over a prolonged period of time, there is a risk that the individual layers could come loose and come out of the ends of the honeycomb body. The common fixing zone prevents the individual layers from coming loose. In addition the fixing zone forms a location of particular stability for the entire honeycomb body.

In accordance with an added feature of the invention, the common fixing zone defines a first common fixing zone, and the wound sheet-metal layers are fixed in a second common fixing zone at the second edge region. The structuring of the structured sheet-metal layers is at least partially flattened at the second common fixing zone so that adjacent the wound sheet-metal layers lie close against each other at the second common fixing zone.

The common fixing zones may each involve a respective point or spot region, but they may also each extend along a respective line. It is preferred that two common fixing zones be disposed approximately in an opposite relationship. That particularly stabilizes the honeycomb body. In addition that can provide advantages in the production process because production steps which are necessary under some circumstances for the fixing zones are effected at approximately the same level on both lateral edge regions. The configuration of the fixing zones is preferably selected such that the honeycomb body has one or more preferential directions in which it enjoys particular strength.

A common fixing zone can be formed, for example, by squeezing all of the sheet layers together in the zone. If the sheet layers are wound, that winding is effected in the region of the fixing zone in such a way that the sheet layers come to bear snugly against each other. They can no longer be displaced because of the friction that occurs between them.

In accordance with an additional feature of the invention, the wound sheet-metal layers include first or outward sides and second or inward sides, and the inward sides are durably connected to respective adjacent outward sides at the common fixing zones. This additionally prevents mobility of the sheet layers.

The connection can be provided by soldering, welding, adhesive means, or other known structures providing connection. That also includes providing structural configurations in the sheet layers, which ensure that outward and inward sides are in a positively locking engagement. These can involve interlacing configurations, tooth configurations, and/or notch configurations as well as corresponding fold configurations of the sheet layers.

A portion of the sheet layers is structured. To provide a fixing zone that is arranged in a lateral edge region, the structuring must be flattened at the fixing zone, at least to such an extent that adjacent inward and outward sides come to bear against each other. Flattening can be promoted in the region of the fixing zone by providing the structuring of the structured sheet layer to be at least smaller than that in the rest of the flattened cross-sectional region. The shaping of the flattened cross-sectional region can therefore have a regular configuration at least in a certain portion. A transition in respect of the structuring can then be limited to the region of the fixing zone and regions adjacent thereto. That permits the honeycomb body to be constructed with preferential directions in respect of its elasticity characteristic and in respect of its strength characteristic. In particular a corrugation configuration, a curvature configuration, a scallop configuration, and a fold configuration in a sheet are considered to be structuring. It may also have microstructures as well as small incisions and openings. In regard to the structuring and the nature and form of the layer, attention is directed in particular to EP 0 484 364, WO 93/20339, EP 0 152 560 and DE 296 11 143.

Even though the honeycomb body according to the invention eliminates the risk of telescoping of one or more sheet layers, the honeycomb body in an advantageous configuration nonetheless enjoys a degree of flexibility. That permits it to adapt itself to its location of installation and to react to vibration, jarring and impact without suffering from material damage. For that purpose the honeycomb body is of such a construction in a layer-wise manner that at least a portion of one of the layers is flexible. In an embodiment of a layer of that kind comprising a structured sheet and a non-structured sheet, flexibility is achieved because of the yielding nature of the structuring. The structuring can be of a corrugated, folded or other configuration. In another embodiment flexibility is achieved by spacing the sheets forming the sheet layer. When the honeycomb body is compressed, it is elastically deformable until the spacing between the two sheets of the layer has been closed.

In accordance with another feature of the invention, the honeycomb body is wound, produced in a layered arrangement, made up from sheet metal, or at least in part from ceramic, in such a way that the honeycomb body elastically retains its shape even under load. That involves a certain degree of elasticity of at least a portion of the honeycomb body. The honeycomb body can be provided with predetermined areas that can plasticly deform. These areas can prevent the honeycomb body from being destroyed by absorbing the energy causing the areas to deform. The durability of the honeycomb body can be put to use insofar as it can serve as a load-bearing portion of a structure.

The fixing zones provide a honeycomb body that is particularly stable and strong, and enables that stability to be used in conjunction with other components which surround or are disposed in the proximity of the honeycomb body.

In accordance with an additional feature of the invention, the honeycomb body is provided with means for additional positional fixing of at least a portion of the honeycomb body. They are capable of absorbing forces which act on or in the honeycomb body, and thus relieve the load at the connection of the sheet layers to the common fixing zone. In a further development those means are also capable of imparting stability to the honeycomb body and adjacent components. Such means can be, for example, struts means, reinforcements, pins or similar structures that are disposed in or on the honeycomb body.

In accordance with yet another additional feature of the invention, the honeycomb body has a layer construction that is also used as a means for additional positional fixing. The corresponding sheet layer has a first sheet and a second sheet, wherein the first sheet is thicker than the second sheet. For reasons of elasticity it is particularly desirable for the thinner second sheet to be structured while the first sheet bears on or against that structure. If stability is of primary importance, the first sheet has a structure. If it is necessary for the honeycomb body to have different properties in different regions, for example by virtue of its manner of installation, the construction of a layer may be varied by changing the structuring and non-structuring of a sheet, or both sheets may also be structured.

In accordance with yet an additional feature of the invention, the honeycomb body includes a reinforcement layer with at least one end portion. The reinforcement layer is disposed within the wound sheet-metal layers, and at least one of the wound sheet-metal layers is connected to the end portion of the reinforcement layer to provide additional positional fixing of the honeycomb body.

In accordance with a further feature of the invention, at least one of the two common fixing zones bears against the reinforcement. That reinforcement may be an additional sheet insert, a reinforced sheet, or a wall. A component that is configured around the honeycomb body may serve as the reinforcement.

In accordance with a further added feature of the invention, a portion of the honeycomb body is made from a wall of a silencer or muffler, for example, by arranging the layers of the honeycomb body around a wall. The same also applies however in regard to a wall of an exhaust gas system. The wall of the exhaust gas system and the silencer or muffler may serve to subdivide the flow of gas but equally also to guide the flow thereof. For example bend systems which bring together the individual pipes or ducts from the engine block are known. They can now be of such a design configuration that one or more walls of that system are formed by the honeycomb body. In addition silencers or mufflers are also known which are subdivided by partitioning walls. Those partitioning walls may also be a component of a honeycomb body. The wall around which the sheet layers are arranged or which is a component of the honeycomb body desirably has means for positioning the sheet layers. Equally however, the layers arranged around the wall may have means for positioning the sheet layers. The wall/layer co-operation then provides for a particular fixing effect as well as an enhanced level of stability. The means for mutual positioning are recess means, teeth, or notch means that the layer and/or the wall have and which fix them together.

With the foregoing and other objects in view there is provided, in accordance with the invention, a muffler of an exhaust gas system of an internal combustion engine that includes a honeycomb body. The honeycomb body is made from wound sheet-metal layers including structured sheet-metal layers with structuring. The wound sheet-metal layers form an upper side, a lower side disposed remote from the upper side, a first edge region and a second edge region laterally extending from the upper side to the lower side. The second edge region is disposed remote from the first edge region. The wound sheet-metal layers are fixed in a common fixing zone at the first edge region. The structuring of the structured sheet-metal layers is at least partially flattened at the fixing zone so that adjacent wound sheet-metal layers lie close against each other at the common fixing zone. The wound sheet-metal layers preferably form a region with a flattened cross-sectional area.

The honeycomb body is no longer embedded in the exhaust gas system but rather forms a flow portion, upstream and downstream of which other flow portions of the exhaust gas system are connected thereto. The honeycomb body does not necessarily need a tubular casing which is disposed around it. On the contrary the honeycomb body forms the tubular casing itself. The honeycomb body can then be connected thereat to respective flow portions of the exhaust gas system. A preferred area of use of the honeycomb body is in a catalytic converter configuration in an exhaust gas system of an internal combustion engine, in particular a small engine. In that case the honeycomb body is disposed in a space in the exhaust gas system. A particularly space-saving configuration is provided if the honeycomb body is disposed in a silencer or muffler of the exhaust gas system. That space-saving construction in conjunction with the non-telescopability of the honeycomb body also permits accurate matching of the dimensions between a silencer or muffler of an exhaust gas system of an internal combustion engine and the honeycomb body. A suitably designed silencer or muffler therefore has means that are intended to receive a honeycomb body of this kind. In accordance with this aspect of the invention, for example for reasons of easy manageability of installation of the silencer or muffler in the exhaust gas system it is preferable for the honeycomb body to be integrated into the silencer or muffler. A simplification in terms of integration is also afforded by the silencer or muffler having means for fixing the honeycomb body. The means for holding same may also embody this. Suitable means for receiving, integration and/or fixing purposes are walls of the silencer or muffler as well as projections in the silencer or muffler but also transverse web or bar portions or regions which are shaped to correspond to the honeycomb body.

In accordance with a further additional feature of the invention, at least one of the wound sheet-metal layers includes means in the form of a positioner for positioning the wound sheet-metal layers with respect to a wall of the exhaust system. The positioner can be notches, teeth, recesses, or other structures that will now be apparent to those skilled in the art.

A silencer or muffler of that kind provides means that are intended for engagement into at least one layer of the honeycomb body. They serve for fixing purposes but they can also have a stabilizing effect. Teeth, recesses, similar structures, or curvature portions can be used as such means, in which case, when the honeycomb body is configured in relation to a wall of the silencer or muffler, it then has the appropriate means. As the honeycomb body itself has a material value which can be increased by a catalytic coating, the silencer or muffler is desirably so designed that the honeycomb body can be interchangeably fitted in position. That also provides an advantage in another respect. When the honeycomb body is used as a catalytic converter and it has reached a condition in which it no longer operates in accordance with the statutory requirements, it is possible to replace just the catalytic converter. The entire exhaust gas system does not need to be replaced. Structural matching of the silencer or muffler and the honeycomb body in that way is found to be environmentally friendly and saves time in regard to recycling and re-utilizing used vehicles or other used articles.

In accordance with yet an added feature of the invention, a part of the silencer or muffler exerts a force, in particular a clamping force, on the honeycomb body. That can be effected by the means for holding the honeycomb body and also by the means for fixing same. The force prevents the honeycomb body or one or more sheet layers thereof from shifting out of the inserted position thereof when the silencer or muffler is in operation over a prolonged period of time. An effect of that kind can be enhanced by a portion of the honeycomb body being squeezed by the silencer or muffler. Preferably, the housing of the muffler exerts the force on the honeycomb body.

With the foregoing and other objects in view there is provided, in accordance with the invention, a housing for a honeycomb body. The housing has a top shell portion and a bottom shell portion which together form a cavity, and a wall dividing the cavity into two regions. The honeycomb body is configured around the wall. The housing may be a silencer or muffler, but it may also be a component of a chemical or other installation in which a construction of that kind is required.

With the foregoing and other objects in view there is provided, in accordance with the invention, a process for the production of a honeycomb body having a top side, an underside, a first end and a second end and at least a first lateral edge region. The honeycomb body preferably has a flattened cross-sectional region with wound metal sheet layers, of which at least a portion is structured. The process for producing a honeycomb body includes the following steps. Forming a layer combination including a structured sheet-metal layer and a non-structured sheet-metal layer. Bending the layer combination to form a honeycomb body with an upper side and a lower side. Forming an edge region that laterally extends from the upper side to the lower side; and producing a common fixing zone at the edge region.

In accordance with an added mode of the invention, the bending step is performed by bending the layer combination around itself to form the honeycomb body.

In accordance with an additional mode of the invention, the bending step is performed by bending the layer combination around a reinforcement to form the honeycomb body.

In accordance with another mode of the invention, the layer combination is coated with a catalytically active material prior to performing the bending step.

In accordance with an additional added mode of the invention, the layer combination is coated with a catalytically active material after performing the bending step.

In accordance with an another added mode of the invention, the steps of forming the edge region and producing the common fixing zone are performed by shaping the layer combination. Particularly good stability of the honeycomb body is achieved by shaping the layer. The honeycomb body can then be produced in a continuous working procedure without an interruption therein.

In accordance with yet another mode of the invention, another edge region that laterally extends from the upper side to the lower side is formed, and a common fixing zone is produced at the other edge region.

In accordance with a concomitant mode of the invention, the steps of producing the common fixing zone at the edge region and performing the step of producing the common fixing zone at the other edge region are performed such that the common fixing zone at the edge region is disposed approximately opposite the common fixing zone at the other edge region.

Other features which are considered as characteristic for the invention are set forth in the appended claims.

Although the invention is illustrated and described herein as embodied as a honeycomb body with a flattened cross-sectional region and a method for producing the honeycomb body, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
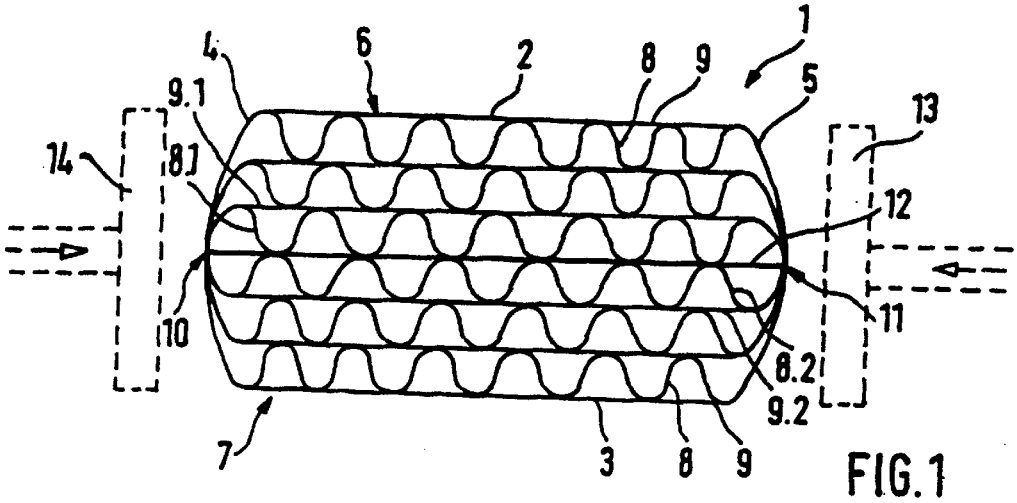
FIG. 1 shows a honeycomb body with two fixing zones and a corresponding production process.

Referring now to the figures of the drawings in detail and first, particularly, to FIG. 1 thereof, there is seen a honeycomb body 1 with a top side 2, an underside 3, a first lateral edge region 4, and a second lateral edge region 5. The honeycomb body 1, as shown viewed from the first end 6, has a flattened or oblate cross-sectional region and has wound sheet metal layers 7. The layers 7 are made up from a structured sheet 8 and an unstructured sheet 9. All of the layers 7 are fixed at common fixing zones 10, 11 that are arranged at the lateral edge regions 4, 5. A first common fixing zone 10 is disposed approximately centrally in the honeycomb body 1. A second common fixing zone 11 is disposed opposite the first common fixing zone 10. At each of the first common fixing zone 10 and the second common fixing zone 11, all sheets 8, 9 of the sheet layers 7 bear jointly against each other. A thick sheet 12 is disposed between the first common fixing zone 10 and the second common fixing zone 11. The sheet 12 extends between the two common fixing zones 10, 11 and serves as a basis for the production of the honeycomb body. For example, a first structured sheet 8.1 and a first unstructured sheet 9.1 can be fitted onto the thick sheet 12 at the first common fixing zone 10 and then can be progressively arranged along the thick sheet 12 towards the end of the thick sheet 12 that is opposite the first common fixing zone 10. The first structured sheet 8.1 and the first unstructured sheet 9.1 are passed around the end of the thick sheet 12 and are arranged along the thick sheet 12 back towards the first common fixing zone 10. In this manner, the sheets 8.1, 9.1 form the second structured sheet 8.2 and the second unstructured sheet 9.2. The structured sheets 8 and the unstructured sheets 9 are passed so closely around the thick sheet 12 that all sheets 8, 9 of the layers 7 bear against each other in frictional contact. A first ram 13 is used to press the sheet layers 7 together at the second common fixing zone 11. That pressing operation is repeated at the opposite end, using the second ram 14. It is thereby possible to change the shape of the structuring and to provide assistance in wrapping the sheets 8, 9 around the thick sheet 12 which acts as a reinforcement. In a somewhat modified production procedure the honeycomb body 1 can be turned around its longitudinal axis so that a single ram 13 is sufficient to apply pressure to the sheet layers 7 in the respective fixing zones 10 and 11.

Figure 2:
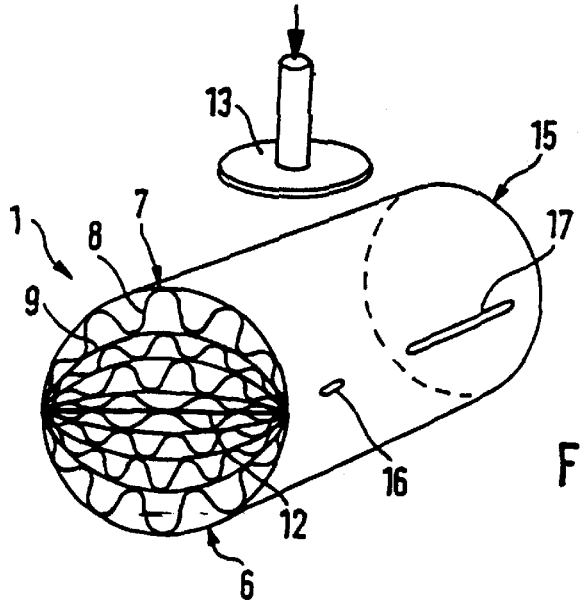
FIG. 2 shows a further honeycomb body and another production process.

FIG. 2 is a view of another honeycomb body 1, showing its axial extent, its first end 6, and its second end 15. The honeycomb body 1 has wound sheet layers 7 which are made up from a structured sheet 8 and an unstructured sheet 9. A thick reinforcement sheet 12 is disposed in the center of the honeycomb body around which the sheet layers 7 are wound. The corrugation configuration of the structured sheets 8 changes over the cross-section so that in the interior of the honeycomb body 1 there is an extremely flattened cross-sectional region. The flattening decreases somewhat in an outward direction (shown vertically). The honeycomb body 1 further has four common fixing zones, two of which can be seen from the view shown in FIG. 2. One fixing zone 16 forms a point or spot region while the other fixing zone 17 extends along a line. The position of the two fixing zones 16 and 17 is naturally dependent on the construction of the honeycomb body 1. If it changes over the axial extent thereof, the fixing zones 16 and 17 are correspondingly displaced in the lateral edge regions. The illustrated first ram 13 can be used in at least two ways. If the honeycomb body 1 while it is being formed is turned in the course of the production procedure, the first ram 13 presses the respective sheet layer 7 against the lateral edge region in such a way that the common fixing zones 16 and 17 are produced. The first ram 13 is also capable of deforming the entire honeycomb body 1 or parts thereof in such a way that it has a flattened or oblate cross-sectional region.

Figure 3:
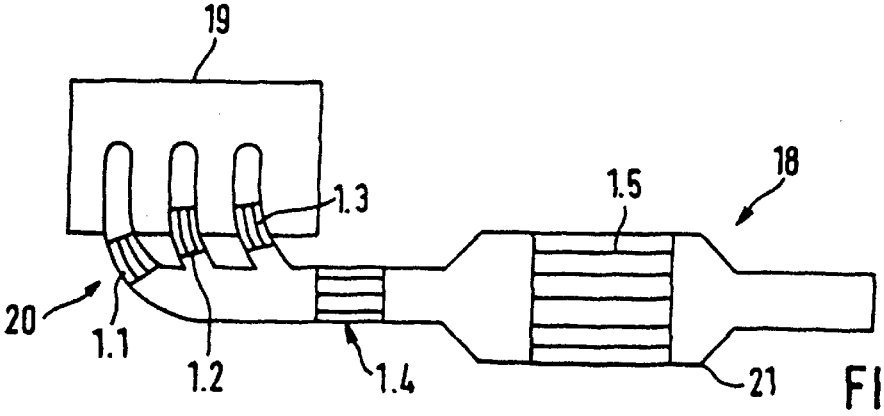
FIG. 3 shows various arrangements of a honeycomb body in an exhaust gas system.

FIG. 3 shows various possible arrangements of the honeycomb bodies in an exhaust gas system 18 of an internal combustion engine 19. For example three honeycomb bodies 1.1, 1.2 and 1.3 are arranged in the bend region 20. A further honeycomb body 1.4 is disposed downstream thereof in the region where the flows are brought together. The silencer or muffler 21 is indicated by the conical enlargement and subsequent reduction. A honeycomb body 1.5 is also disposed therein. The shape of the illustrated honeycomb bodies 1.1 to 1.5 always has a flattened cross-sectional region. The first honeycomb body 1.1 and the second honeycomb body 1.2 arranged in the bend region 20, for example, have cross sectional areas that increase in a conical configuration. The third honeycomb body 1.3 in the bend region 20 has about the same width, but it has a curvature.

Figure 4:
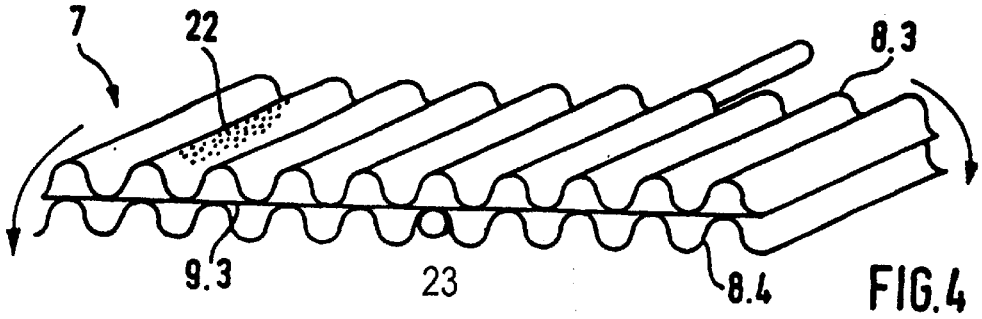
FIG. 4 shows a further production process for a honeycomb body.

FIG. 4 clearly shows the way in which a honeycomb body can also be produced. A layer 7 with a first structured sheet 8.3, a second structured sheet 8.4 and an unstructured sheet 9.3 are provided with a catalytic coating 22. Sheet 8.3 and sheet 8.4 are connected to sheet 9.3 at the respective regions of contact. These connections can be obtained by soldering, spot welding, or by similar connecting procedures. The ends of the sheet layer 7 are wound around a bending mandrel or bar 23 as indicated by the arrows, and for example, can be folded together more or less in half.

Figure 5:
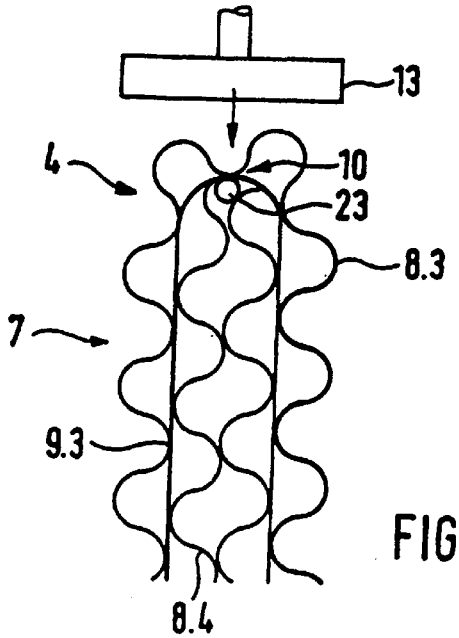
FIG. 5 shows a further processing step for a production process corresponding to that shown in FIG. 4.

FIG. 5 shows the way in which a sheet layer 7 which has been folded together as described above can be subjected to further processing. A first ram 13 moves towards the first lateral edge region 4 and in so doing bends the structured sheet 8.3 over in such a way that a common first common fixing zone 10 is formed. In order to be able to offer a counterpart support for the first ram 13, the bending mandrel or bar 23 remains in the sheet layer 7, while the first ram 13 is moved against the sheet layer. Suitable selection of the shape of the bending mandrel or bar 23 makes it possible to subsequently impart a configuration to the first lateral edge region 4. Depending on the desired properties of the honeycomb body, the first structured sheet 8.3 can have a different material thickness or gauge than that of the unstructured sheet 9.3 and vice versa. Changing the thickness can adjust the elasticity characteristic of the honeycomb body. The structuring, in this case the corrugation configuration, of the second structured sheet 8.4 which is now disposed at an inward position can also be such that a space or spacing is provided for the honeycomb body to behave elastically.

Figure 6:
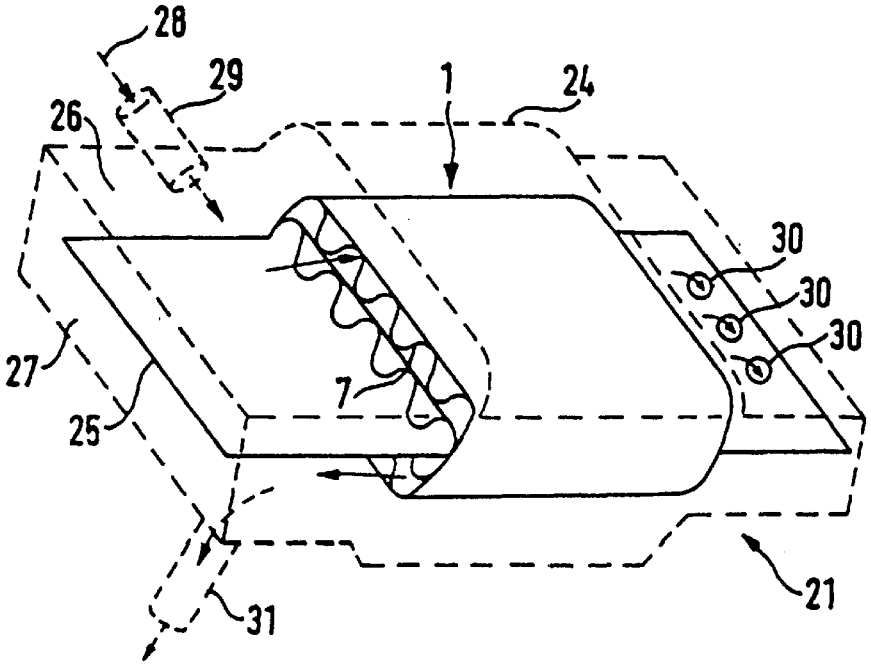
FIG. 6 shows a honeycomb body integrated in a wall of a silencer or muffler.

FIG. 6 shows an arrangement of a honeycomb body 1 surrounded by a silencer or muffler housing 24 shown in dashed lines. The honeycomb body 1 is again made up of sheet layers 7. A wall of the silencer 21 is integrated into the honeycomb body 1. The wall 25 of the silencer 21 subdivides the space in the silencer into an upper space 26 and a lower space 27. An exhaust gas flow 28 is introduced into the upper space 26 through a first connection 29 and is guided by the configuration including the wall 25 through a first part of the honeycomb body 1 to openings 30 which communicate with the lower space 27. The exhaust gas 28 flows through the lower space 27 including a second part of the honeycomb body 1. The gas flow 28 then leaves the silencer 21 through a second connection 31. The honeycomb body 1 with its flattened cross-section is particularly adapted to the shape of the silencer housing 24. It has in means to hold the wall 25 so that the honeycomb body 1 that is integrated with the wall 25 is fixed in a stable manner.

Figure 7:
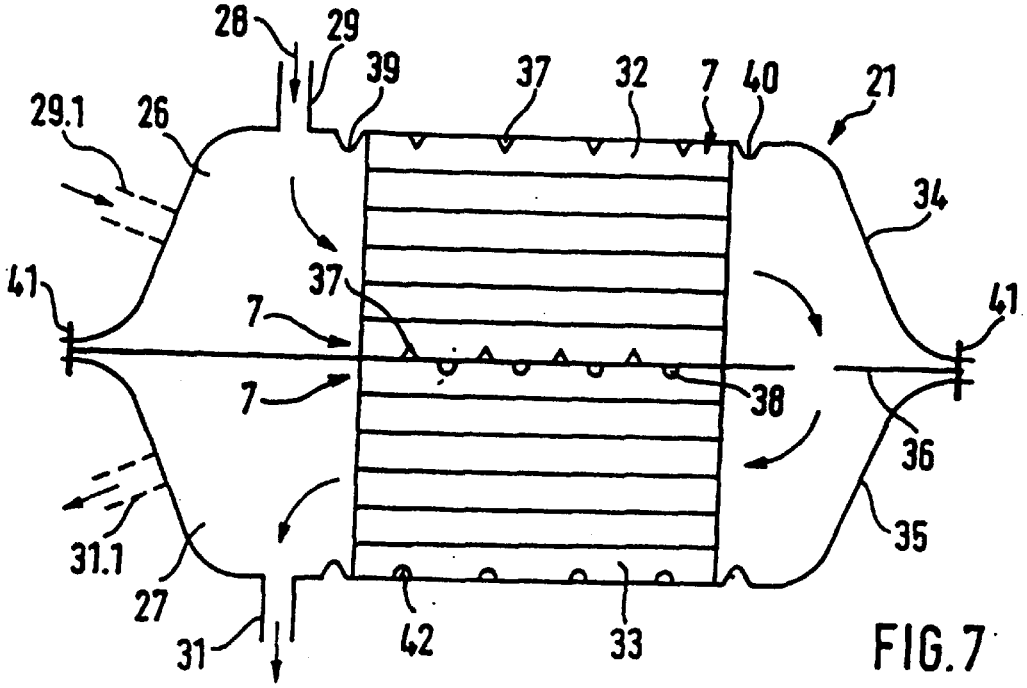
FIG. 7 shows a silencer or muffler corresponding to FIG. 6.

FIG. 7 shows a first honeycomb body 32 and a second honeycomb body 33 in a silencer or muffler 21. An exhaust gas flow 28 is passed through the silencer 21, as indicated by the arrows. The silencer 21 has a top shell portion 34 and a bottom shell portion 35, between which the two honeycomb bodies 32 and 33 are configured. A partition wall 36 is disposed between the first honeycomb body 32 and the second honeycomb body 33. The partition wall 36 subdivides the silencer 21 into the upper space 26 and the lower space 27. The partition wall 36 also has teeth 37 or recesses 38 which co-operate with a respective layer 7 of the first honeycomb body 32 and with a respective layer 7 of the second honeycomb body 33. The teeth 37 or recesses 38 fix the two honeycomb bodies 32 and 33 with respect to the partition wall 36. The top shell portion 34 also has a first groove 39 and a second groove 40. The grooves 39 and 40 assist with the positioning of the first honeycomb body 32. The top shell portion 34 also has teeth 37 which engage into a layer 7 of the first honeycomb body 32. The top shell portion 34, the bottom shell portion 35 and the partition wall 36 are connected together by securing means 41. Those securing means 41 are releasable so that the honeycomb bodies 32 and 33 can be replaced. The top shell portion 34 and the bottom shell portion 35 have a design configuration so that when the silencer 21 is assembled, for example by tightening securing means 41, the top and bottom shell portions 34 and 35 apply a pressure to the first and second honeycomb bodies 32 and 33. The teeth 37 or raised portions 42 engage, clamp, and/or squeeze at least portions of layers 7. Displaced connections 29.1 and 31.1, which are shown in dashed lines, can be provided alternatively to the connections 29 and 31, have advantages in terms of flow dynamics over the first connection 29 and the second connection 31.

Figure 8:
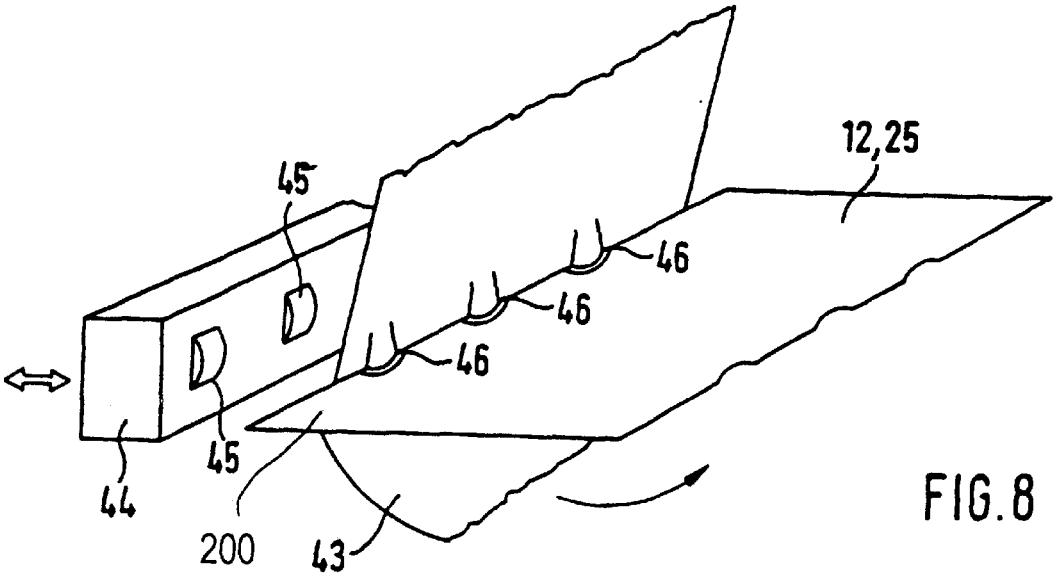
FIG. 8 shows a production process for the integration of a honeycomb body into a wall of a silencer or muffler.

FIG. 8 shows how a reinforcement 12 or a wall 25 can be connected to a sheet 43 of a subsequent layer 7. A ram 44 with ram patterns 45 moves towards the reinforcement 12 and presses the sheet 43 into suitable recesses 46 formed in an end portion 200 of the reinforcement 12. The recesses 46 prevent telescoping of the subsequently formed sheet layers 7 and in that way form a common fixing zone for the subsequent honeycomb body. At least in the common fixing zone, the sheets 43 which are subsequently disposed in mutually superposed relationship can be connected together by soldering or other known connection mechanisms.

Figure 9:
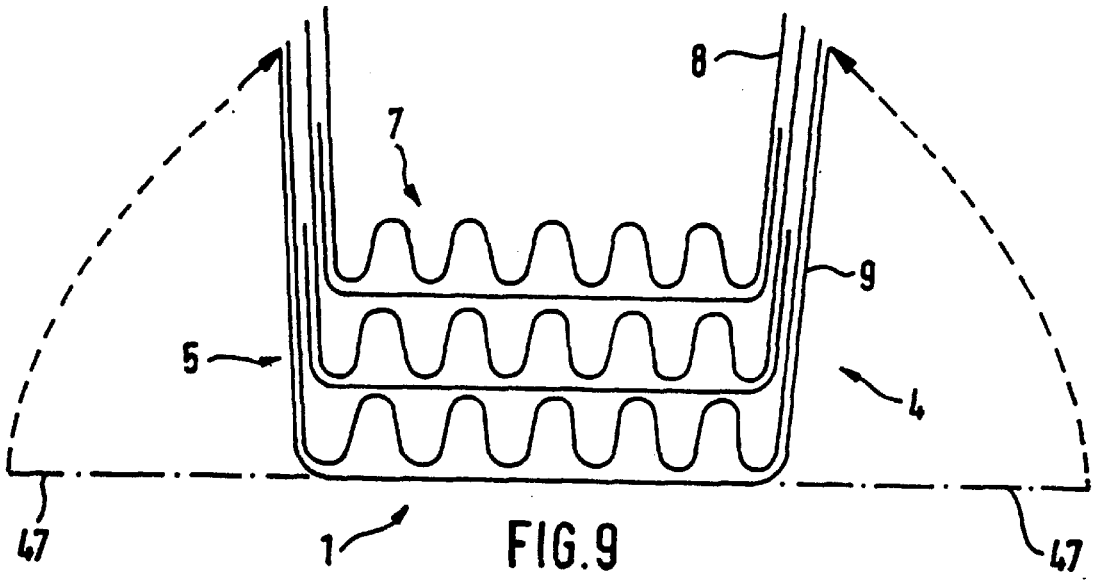
FIG. 9 shows a further production process for a honeycomb body.

FIG. 9 shows a production process for a further honeycomb body 1. This honeycomb body 1 is produced by stacking structured sheets 8 and unstructured sheets 9 one within the other. The ends 47 of the structured and unstructured sheets 8 and 9, which project beyond the actual honeycomb body core which is subsequently formed, are bent over as indicated by the arrows so as to form a first lateral edge region 4 and a second lateral edge region 5. The common fixing zones can then be produced at the lateral edge regions 4, 5 by suitable fixing procedures. The projecting ends 47 are of such a length that they can be shaped around the sheet layers 7 formed from the structured sheets 8 and unstructured sheets 9 to constitute a casing of the honeycomb body 1. To form the casing, the ends 47 of all of the sheets 8, 9 are bent in one working step. The structured sheets 8 and the unstructured sheets 9 with unbent ends 47 are first stacked, and then the entire stack is turned in such a way that the ends 47 of all sheet layers 7 are wound around. That can be effected by rotating the honeycomb body 1 itself or by shaping devices that engage the ends 47 from the exterior.

Figure 10:
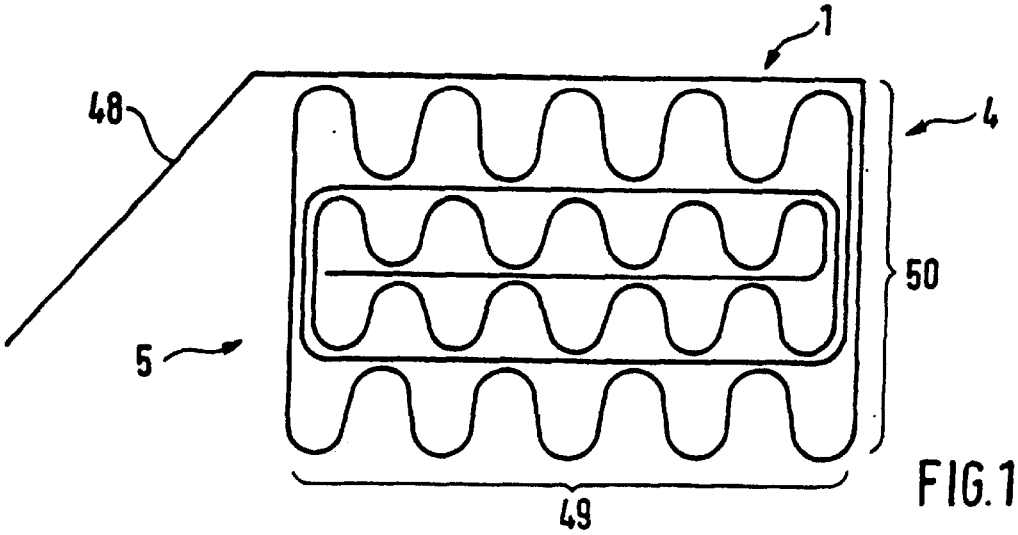
FIG. 10 shows another production process for a honeycomb body.

FIG. 10 shows another process for producing a honeycomb body 1. The honeycomb body 1 is formed by winding an individual sheet 48 about itself. The individual sheet 48 has structured regions 49 and unstructured regions 50. Lateral edge regions 4 and 5 are formed at the unstructured regions 50 in a mutually superposed relationship. This configuration enables many possible ways of producing fixing zones at the lateral edge regions 4 and 5.

Figure 11:
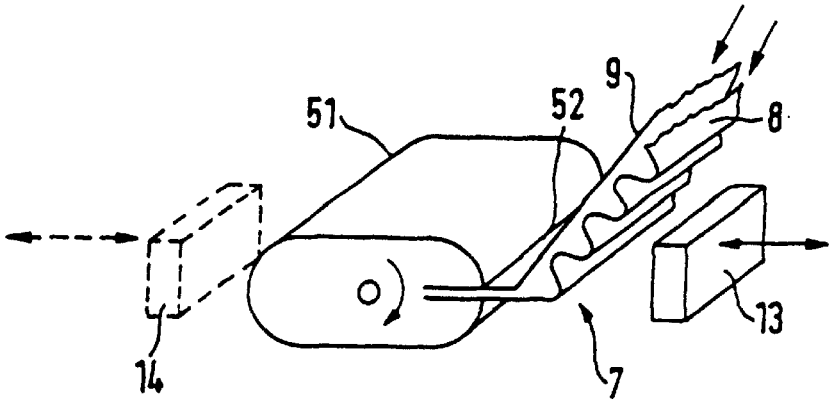
FIG. 11 shows again another production process for a honeycomb body.

FIG. 11 also shows another process for producing a honeycomb body 1. Similar to the process described with reference to FIG. 1, a first ram 13 and a second ram 14 are displaced in such a way as to press against the sheet layer 7. Unlike the situation with the honeycomb body shown in FIG. 1 however, the honeycomb body that is produced does not have a thick sheet 12 (shown in FIG. 1) for stabilization purposes. On the contrary, a structured sheet 8 and an unstructured sheet 9 are introduced into a slot 52 in a rotary body 51. An operation similar to that of a sardine can opener is performed. The two sheets 8 and 9 forming a layer 7 are wound when the rotary body 51 is rotated. The form of the honeycomb body 1 produced is dependent on the geometry of the rotary body 51. The cavity that is formed in the interior of the honeycomb body 1 is preferably large, but can also be kept small, depending on the requirements. An additional honeycomb body can be introduced into the formed cavity. In a further development of the process, the rotary body 51 is left in the honeycomb body 1 and by virtue of its thickness, it serves as a stabilization means and as a receiving means for the honeycomb body that can be additionally introduced.

Figure 12:
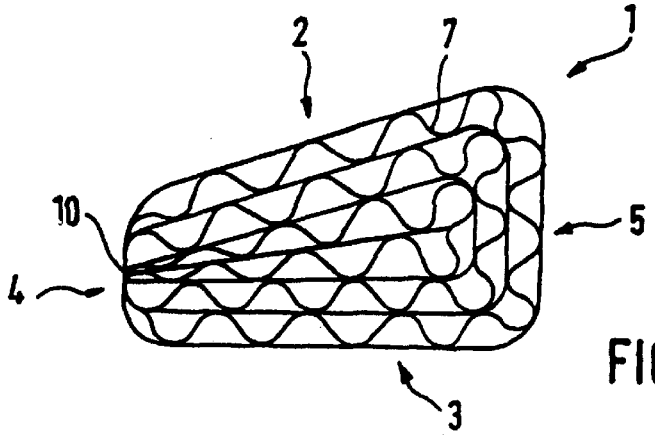
FIG. 12 shows a honeycomb body with a fixing zone.

FIG. 12 shows a further honeycomb body 1. This honeycomb body 1 has a top side 2, an underside 3, a first lateral edge region 4 and a second lateral edge region 5. The first lateral edge region 4 has a first common fixing zone 10 where all of the sheet layers 7 of the honeycomb body 1 are connected together. The honeycomb body has a flattened or oblate cross-section, even if the length relationships between the first lateral edge region 4 and the second lateral edge region 5 are different. The same also applies in regard to the top side 2 and the underside 3. The differences in length between the edge regions 4, 5 and the top side 2 or the underside 3, respectively may also be such that the lateral edge regions 4, 5 are longer. The sides themselves may in that connection be straight, concave, convex or of some other shape. Honeycomb bodies according to the invention may also have more than those four sides, for example, they may be of a hexagonal or other polygonal structure.

Figure 13:
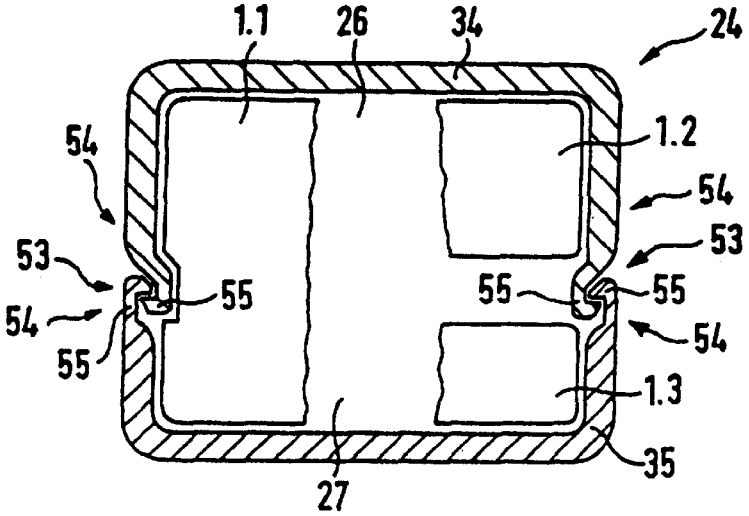
FIG. 13 shows a silencer or muffler housing with various possible configurations of honeycomb bodies.

FIG. 13 shows the arrangement of a first honeycomb body 1.1, a second honeycomb body 1.2 and a third honeycomb body 1.3 which are designed in accordance with the invention, in a silencer or muffler housing 24. The silencer housing 24 has a top shell portion 34 and a bottom shell portion 35. The top shell portion 34 is closed and held to the bottom shell portion 35 by an interengaging closure mechanism 53. End regions 54 of the walls of the top shell portion 34 and the bottom shell portion 35 each form a respective type of hook 55. Those hooks 55 have a configuration so that when the top shell portion 34 is pressed onto the bottom shell portion 35, the end regions 54 of the top shell portion 34 are urged inwardly and the end regions 54 of the bottom shell portion 35 are urged outwardly. In that manner, the hooks 55 which are thus disposed in a mutually opposite relationship, can hook into each other. The internal configuration of the silencer housing 24 can be used in different ways for the honeycomb body or bodies 1.1, 1.2 and 1.3 which are to be configured therein. The first honeycomb body 1.1 which is shown in section is disposed in both an upper space 26 and a lower space 27 of the silencer housing 24. The second honeycomb body 1.2 is disposed in the upper space 26 within the top shell portion 34, and the third honeycomb body 1.3 is disposed in the lower space 27 within the bottom shell portion 35. The figure shows how the hook configurations 55 can be used to hold a respective honeycomb body 1.2, 1.3 within one of the upper 26 and lower 27 spaces. The first honeycomb body 1.1, in contrast, is engaged with a part of the closure mechanism 53 and is thereby fixed in the silencer housing 24.

Figure 14:
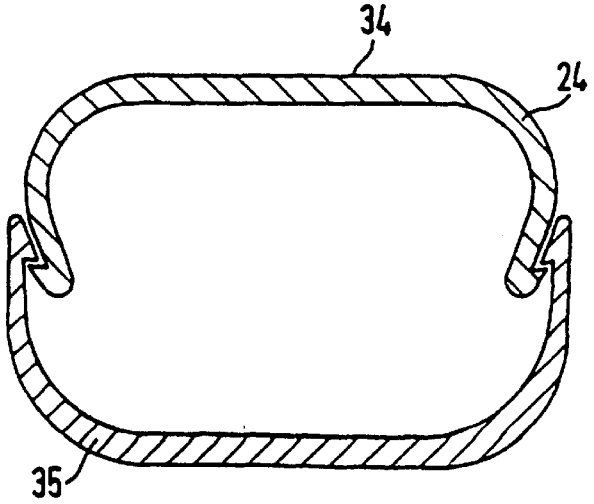
FIG. 14 shows a further silencer or muffler housing.

FIG. 14 shows a further silencer or muffler housing 24 with a top shell portion 34 and a bottom shell portion 35. The silencer housing 24 has a shape such that it can stabily fix a honeycomb body or bodies in its interior. The honeycomb body may therefore be more or less quadrangular, concave or convex. In addition, the silencer housing 24 can have a design configuration such that a honeycomb body 1 similar to that shown in FIG. 12 can be configured therein. In designing the housing 34, consideration will be given to where the common fixing zone or zones are disposed in relation to the silencer housing 24. The common fixing zones are also capable of imparting stability to the silencer housing 24.

Figure 15:
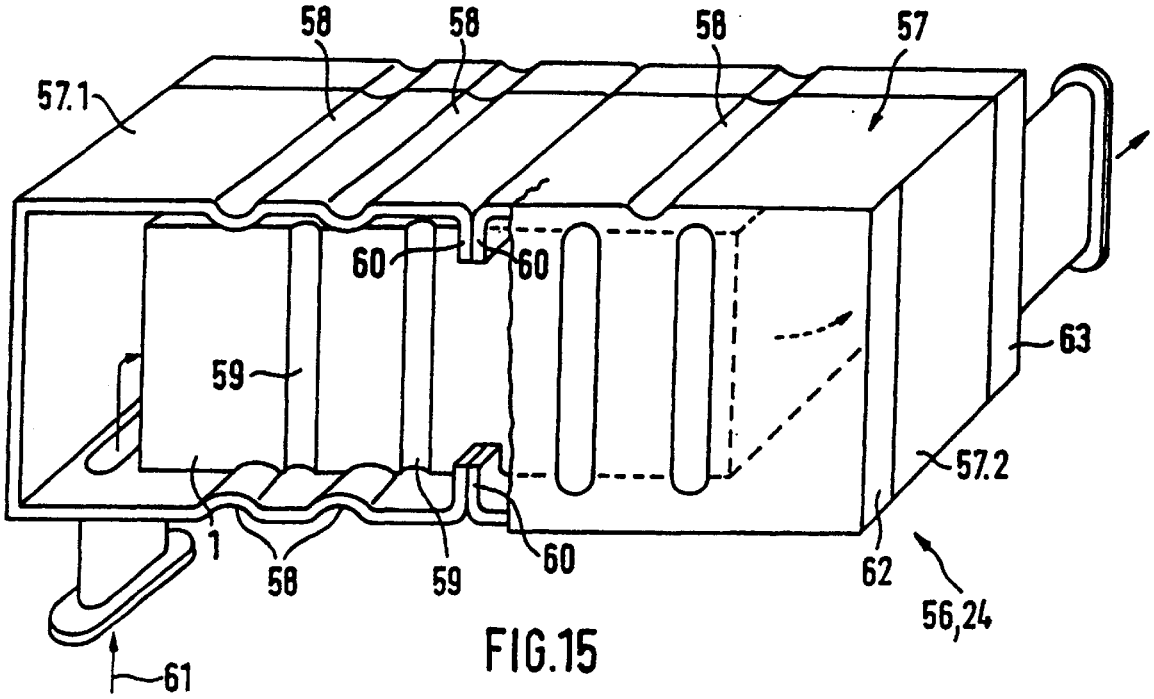
FIG. 15 shows a silencer or muffler housing.

FIG. 15 shows a housing 56 that can be used as a silencer or muffler housing 24. The silencer housing 24 has a base body 57 and it has inwardly extending corrugation-like portions 58 configured to engage corresponding recesses 59 formed in the honeycomb body 1 in the interior of the silencer housing 24. The corrugation-like portions 58 and recesses 59 fix the honeycomb body 1. The base body 57 has a first part 57.1 and a second part 57.2 which each have a bent-over end 60. The bent-over end 60 also engages into the honeycomb body 1. A first cover 62 and a second cover 63 are disposed on the base body 57 for laterally covering it and for preventing the gas 61 flowing through the honeycomb body 1 from flowing out of the configuration. The first cover 62 has inwardly extending curvature portions or recesses 64 which engage into corresponding recesses 59 in the honeycomb body 1. The honeycomb body 1 is laterally fixed by the described configuration. Closing the silencer housing 24 with the laterally fitted covers 62, 63 enables the honeycomb body 1 to be pushed in and out of the base housing 57, and thereby enables replacement of the honeycomb body 1.

Figure 16:
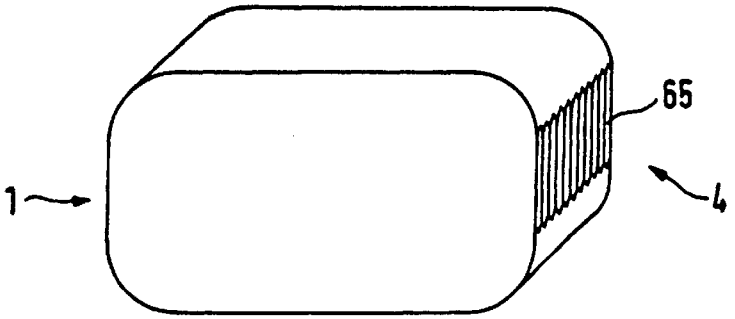
FIG. 16 shows a honeycomb body with an external tooth arrangement.

FIG. 16 shows a further honeycomb body 1 that has a first lateral edge region 4 with a configuration of teeth 65. The teeth 65 are advantageously disposed in the lateral edge region that also includes a fixing zone. When the honeycomb body 1 is pushed into a silencer housing, the teeth 65 prevent the honeycomb body from sliding out again. The degree of fixing can be adjusted by adjusting the orientation of the teeth 65. The teeth 65 can cooperate with other means to prevent the honeycomb body from slipping in the silencer housing so that the honeycomb body 1 remains durably fixed in position. The teeth 65 may not only be disposed on the outside of the honeycomb body 1. Sheets of the honeycomb body 1 may also have teeth so that the sheet layers are in a mutually hooking relationship.

We claim:

1. A honeycomb body, comprising:

wound sheet-metal layers including structured sheet-metal layers with structuring;

said wound sheet-metal layers forming an upper side, a lower side disposed remote from said upper side, a first edge region and a second edge region laterally extending from said upper side to said lower side, said second edge region disposed remote from said first edge region;

said wound sheet-metal layers being fixed in a common fixing zone at said first edge region;

said structuring of said structured sheet-metal layers being at least partially flattened at said fixing zone so that adjacent said wound sheet-metal layers lie close against each other at said common fixing zone.

2. The honeycomb body according to claim 1, wherein said wound sheet-metal layers form a region with a flattened cross-sectional area.

3. The honeycomb body according to claim 2, wherein:

said common fixing zone is disposed within said region with a flattened cross-sectional area; and said structuring of said structured sheet-metal layers in said common fixing zone is smaller than said structuring of said structured sheet-metal layers in a remainder of said region with a flattened cross-sectional area.

4. The honeycomb body according to claim 1, wherein:

said common fixing zone defines a first common fixing zone;

said wound sheet-metal layers are fixed in a second common fixing zone at said second edge region; and said structuring of said structured sheet-metal layers is at least partially flattened at said second common fixing zone so that adjacent said wound sheet-metal layers lie close against each other at said second common fixing zone.

5. The honeycomb body according to claim 4, wherein said first common fixing zone is disposed approximately opposite said second common fixing zone.

6. The honeycomb body according to claim 1, wherein said common fixing zone forms a spot region.

7. The honeycomb body according to claim 1, wherein said common fixing zone extends along a line.

8. The honeycomb body according to claim 1, wherein said wound sheet-metal layers include first or outward sides and second or inward sides, said inward sides being durably connected to respective adjacent said outward sides at said common fixing zone.

9. The honeycomb body according to claim 1, wherein at least a portion of at least one of said wound sheet-metal layers is flexible.

10. The honeycomb body according to claim 1, wherein said wound sheet-metal layers are constructed to retain a particular shape when subjected to a load.

11. The honeycomb body according to claim 1, including a reinforcement layer with at least one end portion, said reinforcement layer disposed within said wound sheet-metal layers, at least one of said wound sheet-metal layers connected to said end portion of said reinforcement layer to provide additional positional fixing of the honeycomb body.

12. The honeycomb body according to claim 1, wherein said wound sheet-metal layers includes a first layer being formed at least partially by a first sheet having a thickness and at least partially by a second sheet having a thickness, said thickness of said first sheet being greater than said thickness of said second sheet.

13. The honeycomb body according to claim 1, including a reinforcement supporting said common fixing zone.

14. The honeycomb body according to claim 1, including a portion forming a wall of a muffler.

15. The honeycomb body according to claim 1, wherein said wound sheet-metal layers cooperate with a wall of an exhaust gas system.

16. The honeycomb body according to claim 15, wherein at least one of said wound sheet-metal layers includes a positioner for positioning said wound sheet-metal layers with respect to the wall of the exhaust system.

17. The honeycomb body according to claim 16, wherein said positioner is selected from the group consisting of notches, teeth, and recesess.

18. The honeycomb body according to claim 15, including a wall forming part of an exhaust gas system, said wall including a positioner for positioning said wound sheet-metal layers with respect to said wall.

19. The honeycomb body according to claim 18, wherein said positioner is selected from the group consisting of notches, teeth, and recesess.

20. The honeycomb body according to claim 1, wherein said wound sheet-metal layers form a portion of an exhaust gas system.

21. The honeycomb body according to claim 1, wherein said wound sheet-metal layers form a portion of a catalytic converter of an exhaust gas system.

22. The honeycomb body according to claim 1, wherein said wound sheet-metal layers form a portion of a muffler of an exhaust gas system.

23. A muffler of an exhaust gas system of an internal combustion engine, comprising:

a honeycomb body, including:

wound sheet-metal layers including structured sheet-metal layers with structuring;

said wound sheet-metal layers forming an upper side, a lower side disposed remote from said upper side, a first edge region and a second edge region laterally extending from said upper side to said lower side, said second edge region disposed remote from said first edge region;

said wound sheet-metal layers being fixed in a common fixing zone at said first edge region;

said structuring of said structured sheet-metal layers being at least partially flattened at said fixing zone so that adjacent said wound sheet-metal layers lie close against each other at said common fixing zone.

24. The muffler according to claim 23, including a portion that is integrated into said honeycomb body.

25. The muffler according to claim 23, including a housing and a positioner for positioning said honeycomb body with respect to said housing.

26. The muffler according to claim 23, including a housing and a positioner engaging at least one of said wound sheet-metal layers for positioning said honeycomb body with respect to said housing.

27. The muffler according to claim 26, wherein said positioner is selected from the group consisting of curved portions, teeth, and recesess.

28. The muffler according to claim 27, wherein said housing includes a wall having said positioner.

29. The muffler according to claim 23, including a housing, said honeycomb body being replaceably inserted within said housing.

30. The muffler according to claim 23, including a housing constructed to apply a clamping force to said honeycomb body.

31. The muffler according to claim 23, including a housing constructed to squeeze at least a portion of said honeycomb body.

32. The muffler according to claim 23, including a housing having a top shell portion and a bottom shell portion which together form a cavity, and a wall dividing the cavity into two regions, said honeycomb body being configured around said wall.

33. The muffler according to claim 23, including:

a housing having a top shell portion and a bottom shell portion which together form a cavity, and a wall dividing the cavity into two regions, said honeycomb body defining a first honeycomb body disposed in one of said two regions; and a second honeycomb body disposed in the other one of said two regions.

34. A housing for a honeycomb body, comprising:

a housing having a top shell portion and a bottom shell portion which together form a cavity, and a wall dividing the cavity into two regions; and a honeycomb body, including:

wound sheet-metal layers including structured sheet-metal layers with structuring;

said wound sheet-metal layers forming an upper side, a lower side disposed remote from said upper side, a first edge region and a second edge region laterally extending from said upper side to said lower side, said second edge region disposed remote from said first edge region;

said wound sheet-metal layers being fixed in a common fixing zone at said first edge region;

said structuring of said structured sheet-metal layers being at least partially flattened at said fixing zone so that adjacent said wound sheet-metal layers lie close against each other at said common fixing zone;

said honeycomb body being configured around said wall.

35. A process for producing a honeycomb body, which comprises:

forming a layer combination including a structured sheet-metal layer and a non-structured sheet-metal layer;

bending the layer combination to form a honeycomb body with an upper side and a lower side;

forming an edge region that laterally extends from the upper side to the lower side; and producing a common fixing zone at the edge region.

36. The process according to claim 35, which comprises performing the bending step by bending the layer combination around itself to form the honeycomb body.

37. The process according to claim 35, which comprises performing the bending step by bending the layer combination around a reinforcement to form the honeycomb body.

38. The process according to claim 35, which comprises coating the layer combination with a catalytically active material prior to performing the bending step.

39. The process according to claim 35, which comprises coating the layer combination with a catalytically active material after performing the bending step.

40. The process according to claim 35, which comprises performing the steps of forming the edge region and producing the common fixing zone by shaping the layer combination.

41. The process according to claim 35, which comprises:

forming another edge region that laterally extends from the upper side to the lower side; and producing a common fixing zone at the other edge region.

42. The process according to claim 41, which comprises performing the steps of producing the common fixing zone at the edge region and performing the step of producing the common fixing zone at the other edge region such that the common fixing zone at the edge region is disposed approximately opposite the common fixing zone at the other edge region.

* * * * *